US006070069A

United States Patent [19]

Yoshinaga

[11] Patent Number: 6,070,069

[45] Date of Patent: May 30, 2000

[54] RADIO SELECTIVE CALLING RECEIVER AND RADIO SELECTIVE CALLING RECEIVING METHOD

[75] Inventor: Masahiko Yoshinaga, Shizuoka, Japan

[73] Assignee: NEC Corporation, Tokyo, Japan

[21] Appl. No.: 08/956,370

[22] Filed: Oct. 23, 1997

[30] Foreign Application Priority Data

Oct. 25, 1996 [JP] Japan ..... 8-283867

[51] Int. Cl.[7] ..... H04Q 7/14

[52] U.S. Cl. ..... 455/416; 455/31.2; 340/825.44

[58] Field of Search ..... 340/825.44, 825.46; 379/209; 371/33; 455/312, 416, 38.1

[56] References Cited

U.S. PATENT DOCUMENTS

| | | | |
|---|---|---|---|
| 4,872,005 | 10/1989 | DeLuca et al. | 340/825.44 |
| 5,093,659 | 3/1992 | Yamada | 340/825.44 |
| 5,436,620 | 7/1995 | Ide | 340/825.44 |
| 5,450,071 | 9/1995 | DeLuca et al. | 340/825.44 |
| 5,604,492 | 2/1997 | Abdul-Halim | 340/825.44 |
| 5,635,914 | 6/1997 | Petreye et al. | 340/825.44 |

FOREIGN PATENT DOCUMENTS

| | | |
|---|---|---|
| 60-9235 | 1/1985 | Japan . |
| 2-179036 | 12/1990 | Japan . |
| 7-327247 | 12/1995 | Japan . |
| 10004578 | 6/1998 | Japan . |
| 01700901 | 12/1998 | Japan . |

*Primary Examiner*—William G. Trost
*Assistant Examiner*—Sonny Trinh
*Attorney, Agent, or Firm*—Whitham, Curtis & Whitham

[57] ABSTRACT

A radio selective calling reception system for limiting recipients participating in a group call limited by setting up a radio selective calling receiver, includes a reception unit, a switch, a numerical string search unit, a numerical string storage unit, a message storage unit, a message unit, a display unit, and a controller connected to each of the foregoing. By manipulating the switch, a message received as a result of a conference call is demodulated by the reception unit, and its included numerical string is extracted by the controller and compared with numerical strings stored in the numerical string storage unit by the numerical string search unit. As a result of a search, a received message is stored in the message storage unit, and the message reception notification operation is performed by the message unit and a loudspeaker connected to the message unit. Since an arbitrary numerical string for sub-group identification is set in the radio selective calling receiver to limit reception for a group call, the storing of unnecessary messages is eliminated, and the memory space provided for message storage is more effectively employed. Accordingly, the load placed on a message transmitter is reduced, and superior radio selective calling receiver is provided for a user. Furthermore, a sub-group is flexibly set or altered and a waste of a finite source, such as individual numbers, is eliminated.

6 Claims, 3 Drawing Sheets

RADIO SELECTIVE CALLING RECEIVER AND RADIO SELECTIVE CALLING RECEIVING METHOD

BACKGROUND OF THE INVENTION

1. Field of the Invention

The present invention relates to a radio selective calling receiver and a radio selective calling receiving method and in particular to a radio selective calling reception for receiving a message as a result of conference calls.

2. Description of the Prior Arts

As a conventional technique related to conference calls (group calls), a selective call reception system is disclosed in Japanese Unexamined Patent Publication No. Sho 60-9235 whereby identification bits are stored in a memory (ID-ROM) prepared for storing individual numbers so that a single ID-ROM can be employed for handling either individual calls or conference calls.

In addition, disclosed in Japanese Unexamined Patent Publication No. Hei 7-327247 is a radio call reception system that, although not intended for conference calls, is optimal for use in a case where a plurality of persons having different identification codes use a single receiver in common.

Conventionally, at the time a group call is initiated to establish a simultaneous connection with a plurality of radio selective calling receivers, all of the receivers that belong to that group transmit reception messages. As a result, transmission of a message to only one receiver of a specific set (sub-group) in a group is disabled. When a message that can be employed by only one part of a group is transmitted as a group call, an important message that is intended for some receiver and that is stored in a message storage memory would be abandoned upon receipt of a number of unnecessary messages.

To resolve this problem for a conventional radio selective calling receiver, individual numbers for sub-groups must be prepared in addition to individual numbers for groups, or a separate call must be performed for each receiver that belongs to a sub-group. However, according to the former method additional individual numbers must be created, and according to the latter method, each receiver must have an individual number for separate calls in addition to one for conference calls. Furthermore, a large load is placed on a transmitter and there is deterioration of transmission efficiency.

SUMMARY OF THE INVENTION

It is an object of the present invention to provide a radio selective calling receiver, and a radio selective calling reception system that enables the initiation of a conference call to a sub-group of a group by limiting the reception notification operation required for a group call.

To achieve the above object, according to the present invention, provided are numerical string storage means for storing a plurality of numerical strings that are set in advance in a radio selective calling receiver, and a numerical string search means for comparing a numerical string added to a received message with one of the numerical strings that are set in the radio selective calling receiver.

In addition, according to the present invention provided are message storage means for storing a received message, notification means for reporting the received message, and display means for displaying message.

A numerical string that is set by a user by employing control means is stored in the numerical string storage means. The numerical string search means searches the numerical string storage means for a numerical string that has been added in advance to a received message reported using the control means, and compares the numerical string with those stored in the numerical string storage means. When a match for the numerical string is found, the message storage means stores the received message upon the receipt of a request from the control means.

The display means receives a request from the control means and displays the received message stored in the message storage means. The notification means transmits a notice upon the receipt of a request from the control means.

Specifically, according to the present invention, in an operating condition set by a switch, a message received as a result of a conference call is demodulated by a reception unit, and a numerical string in the received message is extracted by a controller and compared, by a numerical string search unit, with a numerical string stored in the numerical string storage unit.

According to the present invention, as a result of the search the received message is stored in the message storage unit, and a message reception notification operation is performed by the notification unit, a loudspeaker and the display unit. When, for example, a match for the numerical string in the received message is not found in the numerical string storage unit, the received message can be abandoned in response to a control signal from the controller. Since a reception notification operation for a group call is limited in this manner, a conference call to a sub-group of a group is enabled.

In addition, according to the present invention, when no numerical string that matches the one in the received message is found in the storage unit, the received message can be abandoned in response to a control signal from the control means.

DETAILED DESCRIPTION OF THE PREFERRED EMBODIMENTS

Figure 1:
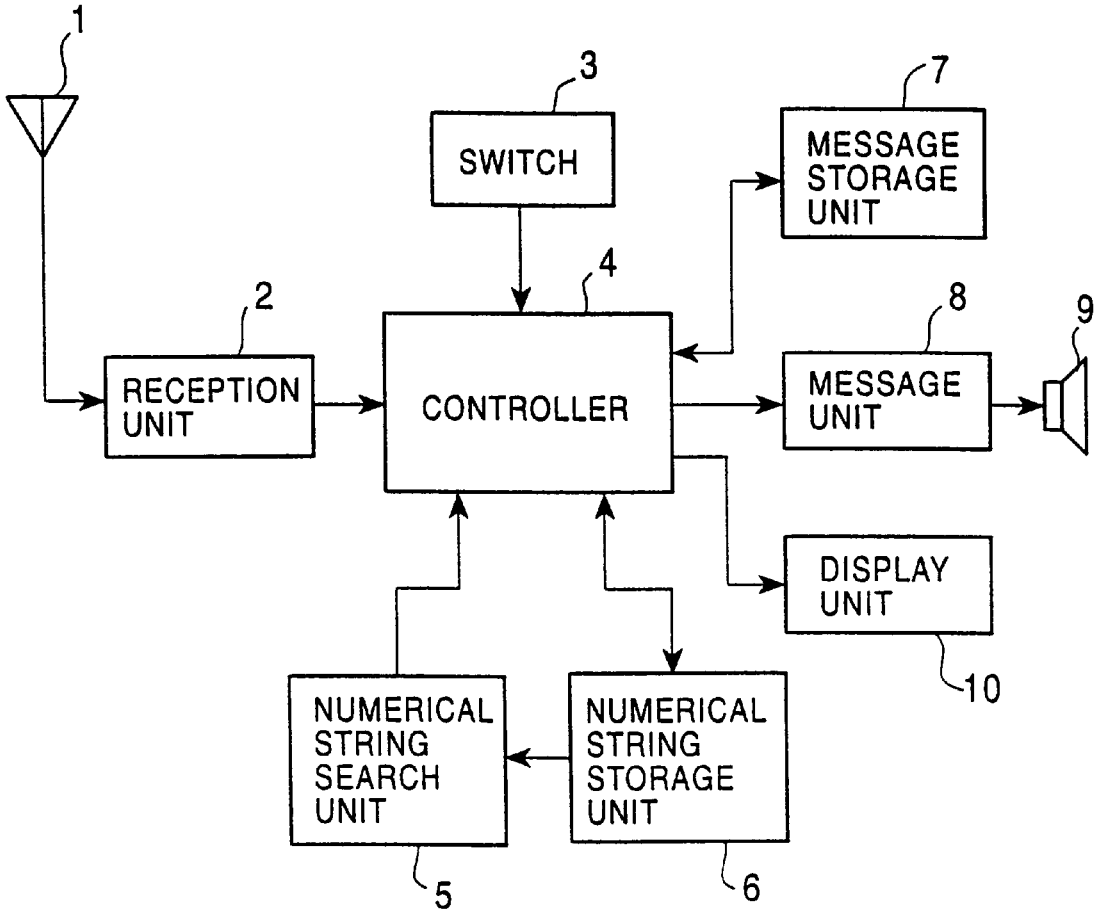
FIG. 1 is a block diagram illustrating the arrangement of a radio selective calling receiver according to the present invention.

The preferred embodiments of a radio selective calling receiver and a radio selective calling reception system of the present invention will now be described while referring to the drawings. FIG. 1 is a block diagram illustrating the arrangement of a radio selective calling receiver according to one embodiment of the present invention.

In FIG. 1, the radio selective calling receiver comprises a reception unit 2, for demodulating a radio signal received by an antenna 1; an operation switch 3; a controller 4, for controlling the entire receiver; a numerical string search unit 5, for searching for a specific group identification numerical string included in a received message; a numerical string storage unit 6, for storing a specific numerical string in advance; a message storage unit 7, for storing a received message; a message unit 8, for issuing a notification that a message has been received; a loudspeaker 9, for reproduction of the audio portion of a message; and a display unit 10, for displaying a received message.

Now, the operation of this embodiment will be described while referring to the accompanying drawings. The antenna 1, which has received a radio signal, notifies the reception unit 2 to that effect. The reception unit 2 demodulates the received radio signal, and extracts a received message and associated information and transmits them to the controller 4. The switch 3 is used to set up an operation for the radio selective calling receiver, and in response to the manipulation of the switch 3, the controller 4 exercises control of various operations.

The numerical string search unit 5, controlled by the controller 4, performs a search to determine whether a numerical string included in a received message matches a numerical string group stored in advance in the numerical string storage unit 6, and notifies the controller 4 of the result of the search, i.e., the presence or the absence of a matching numerical string.

A plurality of numerical strings can be stored in the numerical string storage unit 6, and the controller can rewrite, delete or add a numerical string relative to the numerical string storage unit 6 in response to the manipulation of the switch 3. The message storage unit 7 is used to store a received message and associated information that are transmitted by the controller 4. Upon receipt of the notice from the controller 4, the message unit 8 performs a message operation by using a designated method, and a signal from the message unit 8 is output through the loudspeaker 9. And upon receipt of a notice from the controller 4, the display unit 10 converts designated message data into display characters and displays them.

Figure 2:
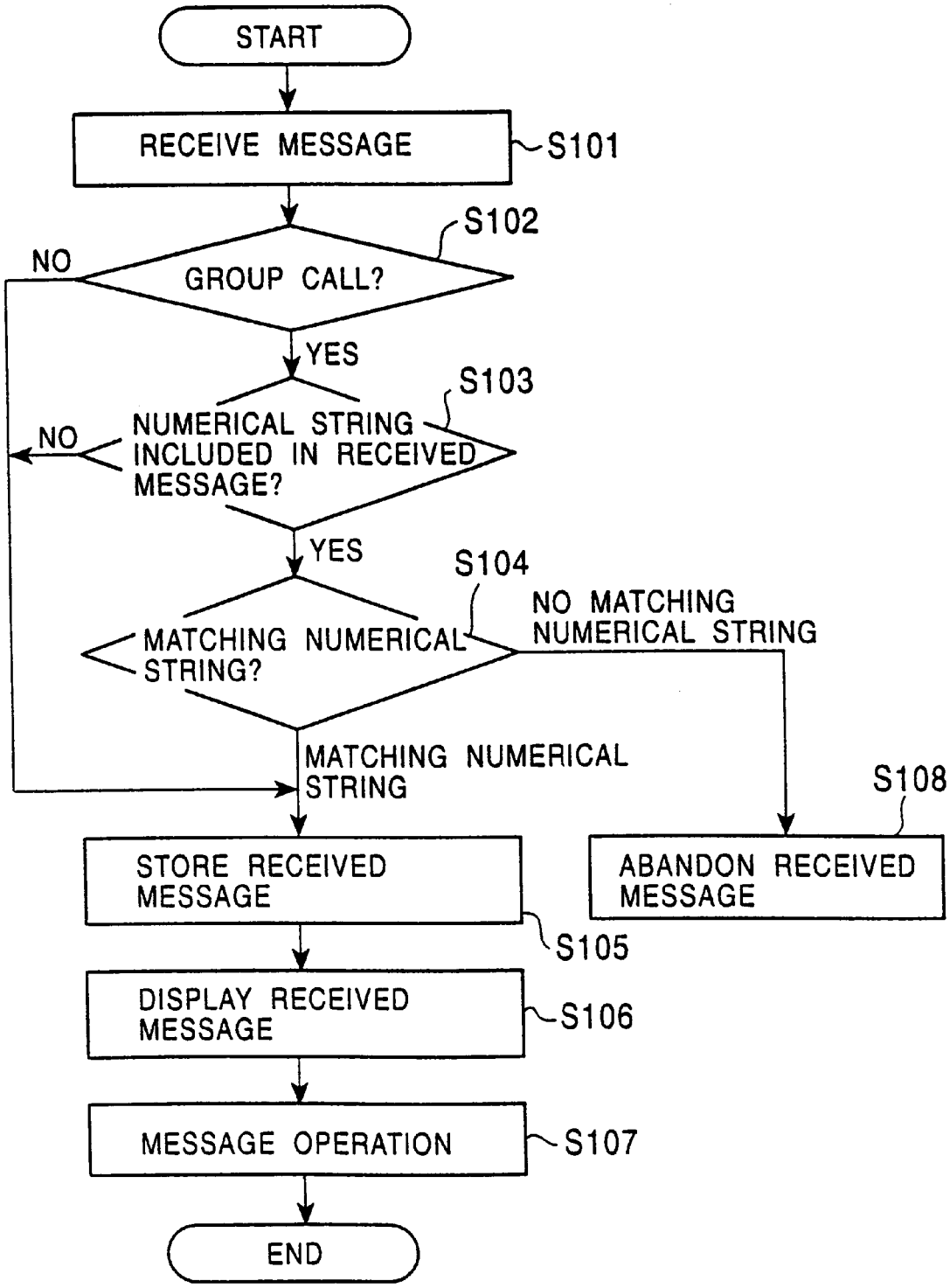
FIG. 2 is a flowchart for a group call reception operation according to one embodiment of the present invention.

At this time the operations performed in this embodiment of the present invention will be described while referring to FIG. 2. In FIG. 2, at step 101 (hereinafter referred to as simply "S101"), the controller 4 receives a message reception notification from the reception unit 2, and temporarily stores the received message data in a memory inside the controller 4. At S102, the individual number of the received message is examined to determine whether the received message is for a group call.

If it is for a group call, at S103 a check is performed to determine whether or not a numerical string has been added to the received message. When a numerical string has been added, at S104 a search is performed to determine whether there is a matching numerical string among those stored in the numerical string storage unit 6. If there is a matching numerical string, at S105 the received message is stored in the message storage unit 7, at step S106 the received message is displayed by the display unit 10, and at S107 the notification operation for the receipt of a message is performed by the message unit 8.

If no matching numerical string is found, at S108 the received message is abandoned. If, at S102, the received message is not for a group call or if, at S103, a numerical string has not been added to the received message, at S105 the received message is stored in the message storage unit 7, at S106 the received message is displayed by the display unit 10, and at S107 the notification operation for the receipt of a message is performed by the message unit 8.

Figure 3:
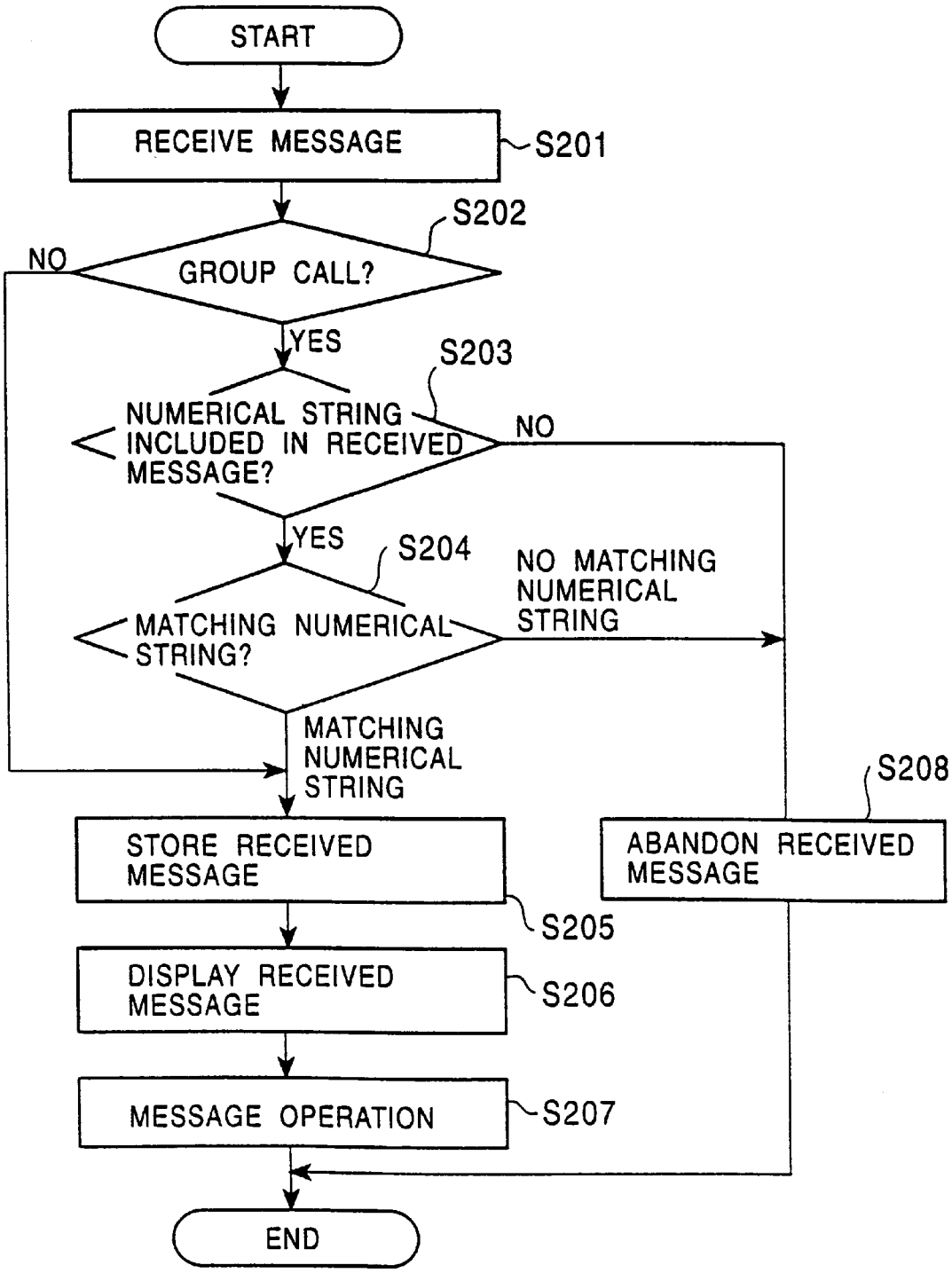
FIG. 3 is a flowchart showing the processing for another embodiment of the present invention.

The operations performed for another embodiment of the present invention will now be described while referring to FIG. 3. In FIG. 3, at S201, the controller 4 receives a notice that a message has been received from the reception unit 2, and temporarily stores the received message in a memory inside the controller 4. At S202, the individual number of the received message is examined to determine whether the received message is for a group call. If it is for a group call, at S203 a check is performed to determine whether a numerical sting has been added to the received message. When a numerical string has been added, at S204 a search is performed to determine whether there is a matching numerical string in a numerical string group stored in advance in the numerical string storage unit 6.

When there is a matching numerical string, at S205 the received message is stored in the message storage unit 7, at S206 the received message is displayed by the display unit 10, and at S207 the notification operation for the receipt of a message is performed by the message unit 8.

When, at S208, no matching numerical string has been found, the received message is abandoned. If, at S202, the received message is not for a group call, at S205 the received message is stored in the message storage unit 7, at S206 the received message is displayed by the display unit 10, and at S207 the notification operation for the receipt of a message is performed by the message unit 8.

When, at S203, a numerical string has not been added to the received message, at S208 the received message is abandoned. Therefore, when a message is to be transmitted to the entire group, a specific numerical string must be stored that is used in common by all the receivers that belong to the group.

In the above described embodiment, numerical strings that are set by a user are stored in the numerical string storage unit 6 by the controller 4. The numerical string search unit 5 searches the numerical string storage unit 6 to determine whether a numerical string that was added in advance to a received message reported by the controller 4 matches one of the stored numerical strings.

The message storage unit 7 stores the received message in response to a request issued by the controller 4 when a matching numerical string is found by the numerical string search unit 5. In response to the request from the controller 4, the display unit 10 displays the message stored in the message storage unit 7, and the message unit 8 transmits a notification message in response to a request from the controller 4.

That is, in the operating condition set by manipulation of the switch 3, a message received as a result of a conference call is demodulated by the reception unit 2, and its included numerical string is extracted by the controller 4 and compared with numerical strings stored in the numerical string storage unit 6 by the numerical string search unit 5.

In the above embodiments, as a result of a search, a received message will be stored in the message storage unit 7, and the message reception notification operation will be performed by the message unit 8, the loudspeaker 9 and the display unit 10. When as a result of the search it is determined that a numerical string does not match one of those stored in the numerical string storage unit 6, the received message can be abandoned in response to a control signal from the controller 4. Therefore, the reception notification operation can be limited for a group call, so that a conference call for a sub-group of a group can be enabled.

In addition, in these embodiments, since an arbitrary numerical string for sub-group identification is set in the radio selective calling receiver to limit reception for a group call, the storing of unnecessary messages can be eliminated, i.e., the memory space provided for message storage can be employed more effectively. Accordingly, the load placed on a message transmitter is reduced, and a more superior radio selective calling receiver can be provided.

Furthermore, in the above embodiments, if an arbitrary numerical string can be set by a radio selective calling receiver, a sub-group can be flexibly set or altered and a waste of a finite source, such as individual numbers, can be eliminated.

As is described above, according to the present invention, since an arbitrary numerical number for sub-group identification is set in a radio selective calling receiver and a reception limit is provided using a group call, the storing unnecessary messages can be eliminated, and the memory space provided for message storage can be used more effectively. In addition, the load placed on a message transmitter can be reduced, so that a more convenient radio selective calling receiver can be provided for a user.

In addition, according to the present invention, if an arbitrary numerical number can be set by a radio selective calling receiver, a sub-group can be set or altered flexibly, and a waste of a finite source, such as individual numbers, can be eliminated.

What is claimed is:

1. A radio selective calling receiver, which has a control means for receiving a message in response to a call signal transmitted across a radio channel, comprising:

an antenna for receiving a radio signal;

a receipt unit which demodulates said radio signal received through said antenna;

a controller which controls individual sections in consonance with a reception signal output by said reception unit;

a numerical string storage unit which stores in advance a plurality of numerical strings designated in response to a control signal output by said controller;

a numerical string search unit having a comparator which compares a numerical string for a received message, if included therein, with each of said numerical strings stored in said numerical storage unit to determine whether a matching numerical string is present in said numerical string storage unit;

a message storage unit which stores received messages transmitted through said controller; and a message unit which effects notification of receipt of received messages stored in said message storage unit, wherein, when said controller determines that a numerical string has not been added to said received message as a result of a conference call, said controller abandons said received message.

2. A radio selective calling receiver according to claim 1, further comprising:

a loudspeaker used for reproducing audio portions of said received message transmitted from said controller to said message unit; and a display unit for displaying said received message.

3. A radio selective calling receiver according to claim 1, wherein during a conference call for simultaneously calling a plurality of receivers, said controller stores, in said message storage unit, a received message that includes a numerical string for which said numerical string search unit has determined that there is a match, and operates said message unit and said display unit; and wherein said controller abandons a received message that includes a numerical string for which said numerical string search unit has determined that there is no match.

4. A radio selective calling receiver according to claim 1, wherein a switch for controlling said controller is further provided and wherein in response to manipulation of said switch said numerical string storage unit arbitrarily rewrites said numerical strings that are to be stored.

5. A radio selective calling reception method, for a radio selective calling receiver having control means for receiving a message in response to a call signal transmitted across a radio channel, comprising steps of:

receiving a radio signal;

demodulating said radio signal;

outputting a control signal in consonance with said demodulated radio signal to control individual sections;

storing in advance a plurality of numerical stings designated in response to a control signal;

determining whether said demodulated radio signal includes a numerical string;

if said radio signal includes a numerical string, performing steps of:

(a) comparing said numerical string with said plurality of stored numerical strings to determine whether a matching numerical string is present, (b) storing a received message for output, and (c) effecting notification of receipt of said received message and if said radio signal does not include a numerical string, abandoning said received message.

6. A radio selective calling reception method according to claim 5, further comprising steps of:

storing, in a message storage unit, at a time of a conference call for simultaneously calling a plurality of receivers, a received message that includes a numerical string for which a match is found;

instructing that a received message be abandoned if a match for said numerical string is not found;

instructing that a normal conference call be performed if a numerical string has not been added to said received message; and abandoning said received message if a numerical string has not been added to said received message as a result of said conference call.

* * * * *